United States Patent [19]

Fabbri

[11] Patent Number: 5,055,985

[45] Date of Patent: Oct. 8, 1991

[54] FLUORESCENT FIXTURE HOUSING

[75] Inventor: William Fabbri, Billerica, Mass.

[73] Assignee: Keene Corporation, Union, N.J.

[21] Appl. No.: 645,577

[22] Filed: Jan. 25, 1991

[51] Int. Cl.[5] ..... F21V 23/02

[52] U.S. Cl. ..... 362/221; 362/150; 362/216; 362/222; 362/260

[58] Field of Search ..... 362/148, 150, 216, 221, 362/222, 225, 240, 260, 364, 365, 346

[56] References Cited

U.S. PATENT DOCUMENTS 3,883,732 5/1975 Peterson et al. ..... 362/150 X 4,149,226 4/1979 Dalton ..... 362/216

*Primary Examiner*—Stephen F. Husar

*Attorney, Agent, or Firm*—Kane, Dalsimer, Sullivan, Kurucz, Levy, Eisele and Richard

[57] ABSTRACT

The apparatus is a nestable fluorescent fixture housing of a truncated pyramid shape with "knock-out" apertures provided on the sloping walls thereof to engage the ends of fluorescent bulbs. A wedge-shaped separate ballast/socket assembly is provided for each fluorescent bulb, preferably a "biax" bulb. The slope of the wedge shape of the ballast/socket assembly is complementary to the slope of the walls of the fixture.

11 Claims, 3 Drawing Sheets

FLUORESCENT FIXTURE HOUSING

BACKGROUND OF THE INVENTION

1. Field of the Invention

This invention pertains to a fluorescent fixture housing for fluorescent, preferably "biax", bulbs. The housing is in the shape of a truncated pyramid. The fluorescent bulbs are engaged through apertures in the housing and held in place by a detachable ballast/socket assembly.

2. Description of the Prior Art

In the prior art, fluorescent fixture housings are well-known. These prior art housings are typically two feet by four feet and typically use fluorescent bulbs approximately four feet in length. This size of housing is difficult to manage and install. Moreover, this size of housing is not adapted to the more modern "biax" bulb which is a high-intensity U-shaped bulb and approximately sixteen inches in length.

Moreover, such a housing is not nestable due to its generally parallelepiped shape and due to the presence of sockets and bulky ballast assemblies required to initiate illumination from the fluorescent bulbs. This inability to nest the prior art fluorescent fixture housings raised shipping costs and generally made the importation of such housings prohibitive.

OBJECTS AND SUMMARY OF THE INVENTION

It is therefore an object of this invention to provide a fluorescent fixture housing which is compact in size.

It is therefore a further object of this invention to provide a fluorescent fixture housing which is adapted to a "biax" bulb.

It is therefore a still further object of this invention to provide a fluorescent fixture housing which is easily nestable so as to reduce transportation costs.

It is therefore a final object of this invention to provide a fluorescent fixture housing with easily detachable sockets and ballast assemblies.

These and other objects are effectively attained by providing a fluorescent fixture housing in the shape of a truncated pyramid. The truncated pyramid shape is easily nestable. The truncated pyramid structure includes a base which is square with twenty-four inch sides so that a "biax" bulb may be accommodated therewithin. The sloping walls of the truncated pyramid include "knock-out" apertures through which the ends of the "biax" bulbs are engaged.

Wedge-shaped ballast/socket assemblies are provided with a sloping wall so as to engage the sloping walls of the fluorescent fixture housing and to secure the "biax" bulbs to the fixture housing. As the ballast-/socket assemblies are detachable from the fluorescent fixture housing, the ballast/socket assemblies do not interfere with the nesting of the fixture housings. Moreover, this allows the fixture housings to be manufactured separately from ballast/socket assemblies. This allows the fixture housings to be manufactured in geographic areas of low technology at correspondingly low expense.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
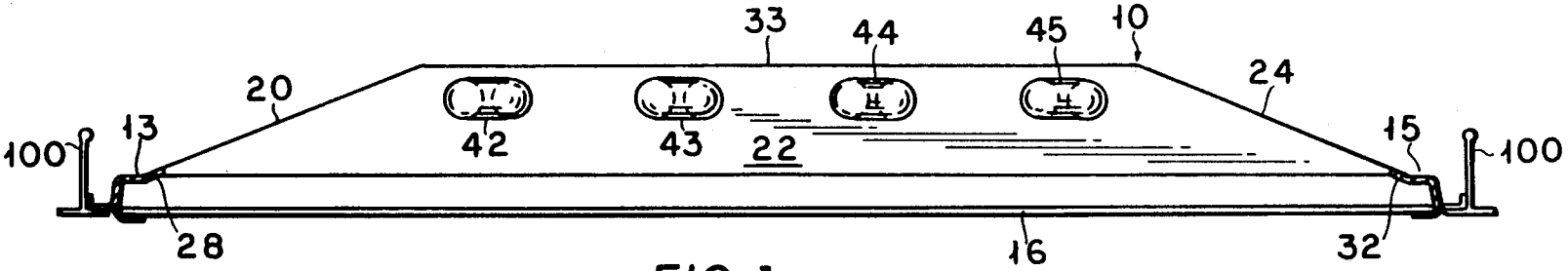
FIG. 1 is a side plan view of the fluorescent fixture housing of the present invention, viewing the "biax" bulbs from a short side thereof.

Referring now to the drawings in detail wherein like numerals indicate like elements throughout the several views, FIG. 1 discloses fluorescent fixture housing 10. The periphery of housing 10 includes flanges 12, 13, 14, 15 which allow housing 10 to be secured by inverted T-shaped rails 100 which form a grid-type ceiling as is well-known in the prior art. Flanges 12, 13, 14, 15 also engage a transparent or translucent cover 16 which diffuses the light which passes therethrough. Walls 18, 20, 22, 24 slopingly rise from the upper lips 26, 28, 30, 32 of flanges 12, 13, 14, 15, respectively.

Top 33 (see FIG. 4) is formed at the uppermost portion of walls 18, 20, 22, 24 thereby forming a truncated pyramid shape for fluorescent fixture housing 10 and forming a reflector on the inner portion of housing 10.

Figure 2:
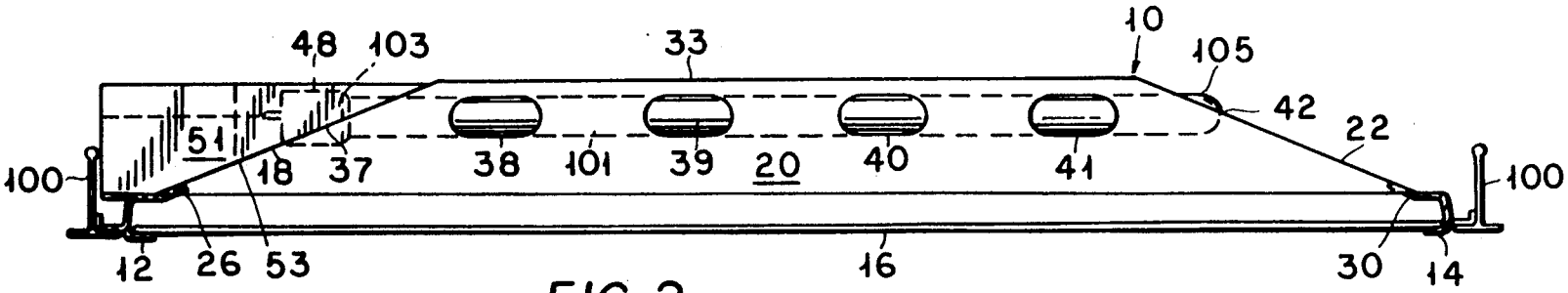
FIG. 2 is a side plan view of the fluorescent fixture housing of the present invention, viewing the "biax" bulbs from a long side thereof.
Figure 4:
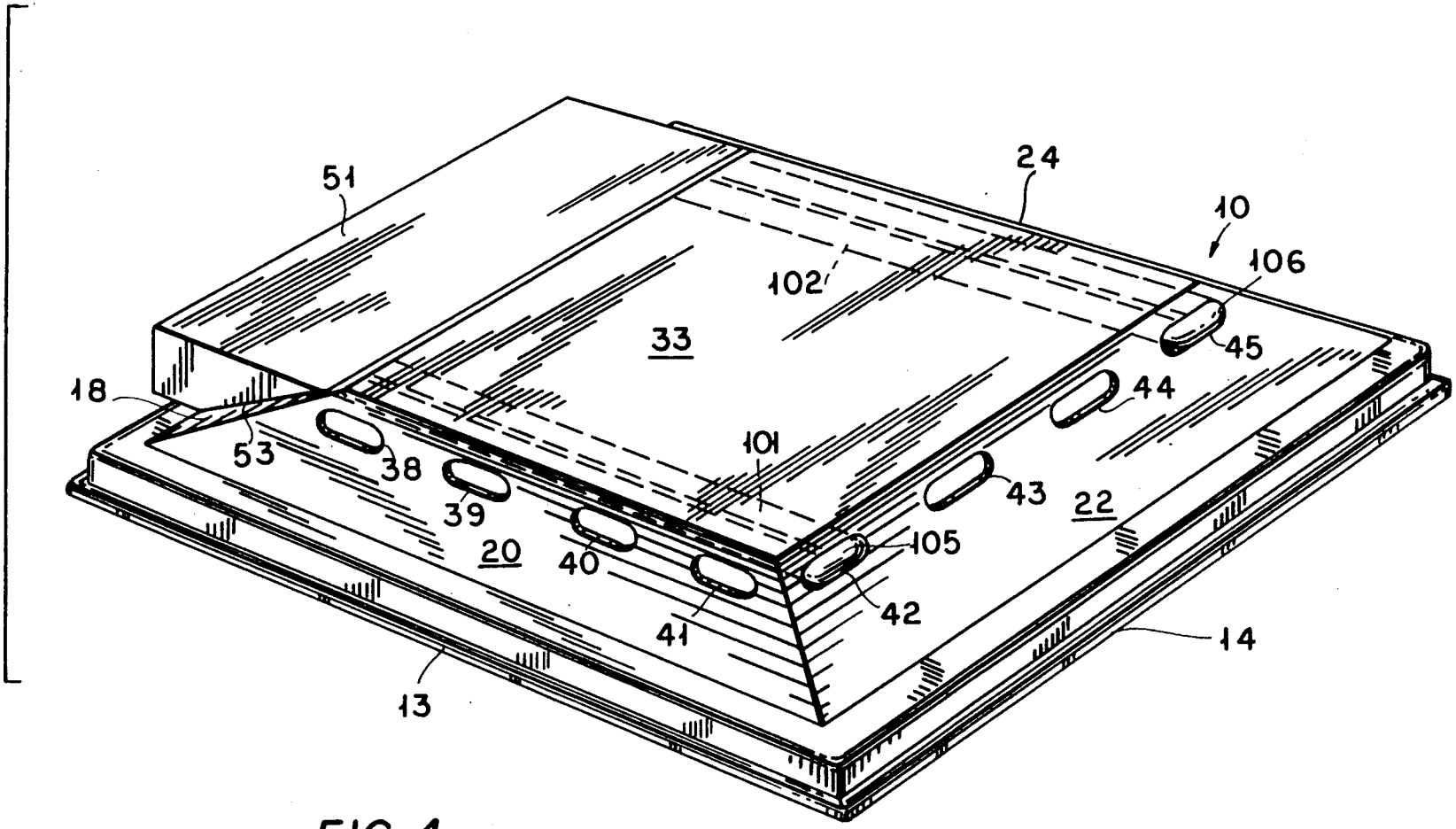
FIG. 4 is a top perspective view of the fluorescent fixture housing of the present invention.

Walls 18, 20, 22, 24 each include four apertures 34–45 (wall 24, which is not shown directly shown in any of the drawings but is a mirror image of wall 20, includes four apertures which are not enumerated but are mirror images of apertures 38–41) which are adapted to engage biax bulbs 101, 102 as shown most clearly in FIGS. 2 and 4. (Aperture 37 is not visible in FIG. 4 but is visible in FIG. 2. Similarly, apertures 34, 35 and 36 are not visible in FIG. 4 but are along wall 18 as mirror images of apertures 45, 44, and 43, respectively.) Fluorescent fixture housing 10 is typically provided with all apertures 34–45 available by "knocking out" partially excised or perforated portions of walls 18, 20, 22, 24.

Figure 3:
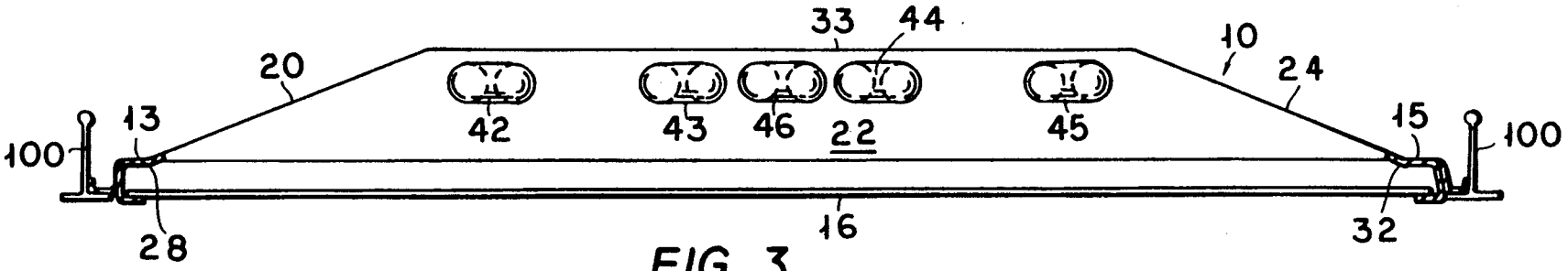
FIG. 3 is a side plan view of the fluorescent fixture housing of the an alternative embodiment of the present invention, showing an extra aperture along a side thereof.

FIG. 3 illustrates an alternative embodiment of fluorescent housing fixture 10 which includes an extra aperture 46 in wall 22. A corresponding aperture, of course, is provided in wall 18. FIGS. 1 and 3 show a biax bulb engaged in each of the illustrated apertures.

The male socket ends 103 of biax bulbs 101, 102, pass through and are supported by apertures 37, 34, respectively, of wall 18. The opposite ends 105, 106 of biax bulbs 101, 102 are supported by apertures 42, 45, respectively, of wall 22.

Male socket ends 103 of biax bulbs 101, 102 are engaged by female socket assembly 48 of wedge-shaped ballast/socket assembly 51. Wedge-shaped ballast-/socket assembly 51 has a sloping lower wall 53 to interchangeably engage the slope of any of walls 18, 20, 22, 24. The combination of ballast/socket assembly 51 and apertures 34, 37, 42 and 45 as most clearly shown in FIG. 4 securely holds the biax bulbs 101, 102 in place.

To use this fluorescent fixture housing 10, the user "knocks out" the desired apertures, installs the biax bulbs and secures the biax bulbs by use of the ballast-/socket assembly. The user then secures the fluorescent fixture housing to the inverted T-rails of the grid-type ceiling.

Thus the several aforementioned objects and advantages are most effectively attained. Although a single preferred embodiment of the invention has been disclosed and described in detail herein it should be understood that this invention is in no sense limited thereby and its scope is to be determined by that of the appended claims.

What is claimed is:

1. A fluorescent fixture housing including:

a truncated pyramid shaped body including a downwardly opening bottom, walls upwardly and inwardly sloping from said bottom, and a top parallel to said bottom, a periphery of said top engaging an upward and inward portion of said walls;

ceiling-mounting means engaging said body; and a plurality of apertures on said walls, said apertures designed to engage ends of fluorescent bulbs.

2. The fluorescent fixture housing of claim 1 wherein said body is symmetrical so as to be nestable with substantially identical bodies.

3. The fluorescent fixture housing of claim 2 further including a detachable wedge-shaped ballast/socket assembly with a sloping lower surface complementary to a slope of said walls.

4. The fluorescent fixture housing of claim 3 wherein said apertures are symmetrically spaced on said walls whereby a male socket of a fluorescent bulb passes through a first of said apertures to be engaged by said detachable wedge-shaped ballast/socket assembly and an opposite end of said bulb is supported by a second of said apertures in an opposing wall.

5. The fluorescent fixture housing of claim 4 wherein said apertures and said ballast/socket assembly are designed to engage biax fluorescent bulbs.

6. The fluorescent fixture housing of claim 5 wherein said apertures are provided by partially excised portions which can be removed to create said apertures.

7. The fluorescent fixture housing of claim 6 wherein said bottom includes a light-diffusing cover.

8. The fluorescent fixture housing of claim 7 wherein said bottom and said top are substantially square-shaped.

9. The fluorescent fixture housing of claim 8 wherein said bottom is substantially twenty-four inches by twenty-four inches.

10. A fluorescent fixture housing including at least one sidewall having a means therein to support a ballast/socket assembly adapted to be mounted to said sidewalls, said ballast/socket assembly including therein at least one lamp socket; and at least one fluorescent bulb having at least one end passing through said sidewall to engage the socket of said ballast/socket assembly.

11. The fluorescent fixture housing of claim 10 wherein each of two adjacent sidewalls have said ballast/socket assembly support means thereon.

* * * * *